US005623839A

United States Patent [19]

Hoggarth et al.

[11] Patent Number: 5,623,839

[45] Date of Patent: Apr. 29, 1997

[54] KNITTED FABRIC AND METHOD OF PRODUCING

[75] Inventors: William R. Hoggarth, Mansfield Woodhouse; John E. Hancock, Mansfield, both of Great Britain

[73] Assignee: Sara Lee Corporation, Winston-Salem, N.C.

[21] Appl. No.: 416,968

[22] Filed: Apr. 5, 1995

[51] Int. Cl.[6] ..... D04B 11/00

[52] U.S. Cl. ..... 66/178 A; 66/202

[58] Field of Search ..... 66/178 R, 178 A, 66/190, 202, 8, 9 R, 38

[56] References Cited

U.S. PATENT DOCUMENTS

| | | | |
|---|---|---|---|
| 2,031,104 | 2/1936 | Gilpin | 66/190 X |
| 2,190,793 | 2/1940 | Lombardi | 66/190 |
| 2,192,798 | 3/1940 | Page et al. | 66/190 X |
| 2,236,758 | 4/1941 | Lumsden | 66/190 |
| 3,461,695 | 8/1969 | Knohl | 66/190 X |
| 3,986,374 | 10/1976 | Fane | 66/190 |
| 4,522,044 | 6/1985 | Lineberry et al. | 66/178 A X |

FOREIGN PATENT DOCUMENTS

| | | | |
|---|---|---|---|
| 1228745 | 11/1966 | Germany | 66/178 A |

*Primary Examiner*—John J. Calvert

*Attorney, Agent, or Firm*—Petree Stockton L.L.P.

[57] ABSTRACT

A hosiery garment including at least a leg portion comprising a fabric defined by a ground knitted structure having a plurality of successive courses knitted from a ground yarn and a bare elastomeric yarn laid-in preferably on every course, or alternatively on alternate courses, of the ground knitted structure so as to cross-over the head of sinker loops between selected wales, the ground and elastomeric yarns being such that the ground knitted structure defines the front and rear faces of the fabric and said elastomeric yarn is located in between and spaced from said front and rear faces so as to be shielded from surface contact with an opposing surface when the front or rear surface of the fabric contacts said opposing surface.

9 Claims, 4 Drawing Sheets

KNITTED FABRIC AND METHOD OF PRODUCING

The present invention relates to a hosiery garment, in particular panti-hose or stockings, and a method of manufacturing a hosiery garment.

With fine hose, in particular panti-hose or stockings, the visual appearance and feel of the hose is important to the wearer.

It is becoming increasingly desirable to provide fine hose having at least the leg portion made from a fabric which exhibits elasticated stretch characteristics which enable the fabric to quickly recover from being stretched whilst not adversely affecting the visual appearance or feel of the hose.

Such elasticated stretch characteristics enable the fabric to readily hug and conform to the contours of the wearer whilst being easily stretched to provide unrestrictive movement of the wearer and therefore, in use, provide a good fitting hose. Generally, to increase the elasticity of a fabric it is known to incorporate an elastomeric yarn. However, the incorporation of elastomeric yarn can create an inferior fabric appearance due to the use of differing yarns and/or an imbalanced stitch configuration.

It has been proposed to produce panti-hose or stockings by knitting an elastomeric yarn such as covered LYCRA (RTM) so that every course of the fabric is defined by knitted loops of the elastomeric yarn. Such a fabric is relatively expensive to produce since it necessarily has to use a covered elastomeric yarn and since it uses a relatively high quantity of the elastomeric yarn. It also involves expensive modifications to the knitting machine in order to enable the elastomeric yarn to be properly knitted.

It is also known to produce an elasticated fabric having courses of knitted loops formed from an elastomeric yarn plaited with a non elastomeric foundation yarn. Again this is expensive due to the relatively high quantity of elastomeric yarn needed although fewer modifications to the knitting machine are required.

An alternative proposal for providing elasticated fabric is to knit a ground fabric structure using a non-elastomeric yarn, such as the type normally used for knitting panti-hose or stockings; e.g. a polyamide filamentary yarn, and incorporating into the ground fabric structure a bare elastomeric yarn by laying-in the barn elastomeric yarn into every course of the fabric. Different examples of this type of fabric are disclosed in UK Patent 898983.

Laying-in an elastomeric yarn on every course is advantageous since it can provide the desired elastication of the fabric and enables less elastomeric yarn to be consumed.

A major deficiency with the elasticated fabric of the type disclosed in UK Patent 898983 is that the bare elastomeric yarn can reside at the surface of the fabric. This has an undesirable affect on the feel of the fabric and can lead to snagging and pulling of the elastomeric yarn from the ground fabric structure.

A general aim of the present invention is to provide a hosiery garment including fabric of the type having a ground fabric structure preferably knitted from non-elastomeric yarns incorporating on every course a laid-in bare elastomeric yarn and which seeks to overcome the above major deficiency.

According to one aspect of the present invention there is provided a hosiery garment including at least a leg portion comprising a fabric defined by a found knitted structure having a plurality of successive courses knitted from a ground yarn and a bare elastomeric yarn laid-in preferably on every course, or alternatively on alternate courses, of the ground knitted structure so as to cross-over the head of sinker loops between selected wales, the ground and elastomeric yarns being such that the ground knitted structure defines the front and rear faces of the fabric and said elastomeric yarn is located in between and spaced from said front and rear faces so as to be shielded from surface contact with an opposing surface when the front or rear surface of the fabric contacts said opposing surface.

According to another aspect of the invention there is provided a hosiery garment including at least a leg portion comprising a fabric defined by a ground knitted structure having a plurality of successive courses knitted from a ground yarn and bare elastomeric yarn laid-in preferably on every course, or alternatively on alternate courses, of the ground knitted structure so as to cross-over the head of sinker loops between adjacent first and second groups of wales defined by needle loops of ground yarn, the laid-in elastomeric yarn having spaced length portions which extend across the technical back of each first group of wales, the ground yarn and elastomeric yarn being such that said length portions of the elastomeric yarn are enclosed within the ground yarn of the needle loop heads in said first group of wales so that said lengths of elastomeric yarn reside below the technical back surface of the fabric.

According to another aspect of the present invention there is provided a method of producing an elasticated knitted fabric including knitting a ground structure from a ground yarn so as to have needle loops defining a plurality of consecutive courses and alternate first and second groups of wales, laying-in preferably on every course, or alternatively on alternate courses, an elastomeric yarn so as to cross-over sinker loops inbetween said first and second groups of wales, and selecting the ground and elastomeric yarns so that length portions of the elastomeric yarn extending across the technical back of the first group of wales are enclosed within the portions of ground yarn defining the needle loop heads in said first group of wales so as to be shielded thereby.

Various aspects of the present invention are hereinafter described, with reference to the accompanying drawings, in which:

FIG. 5 is a diagrammatic view of a yarn feeding station of a circular knitting machine at which elastomeric yarn is being laid-in;

Figure 1:
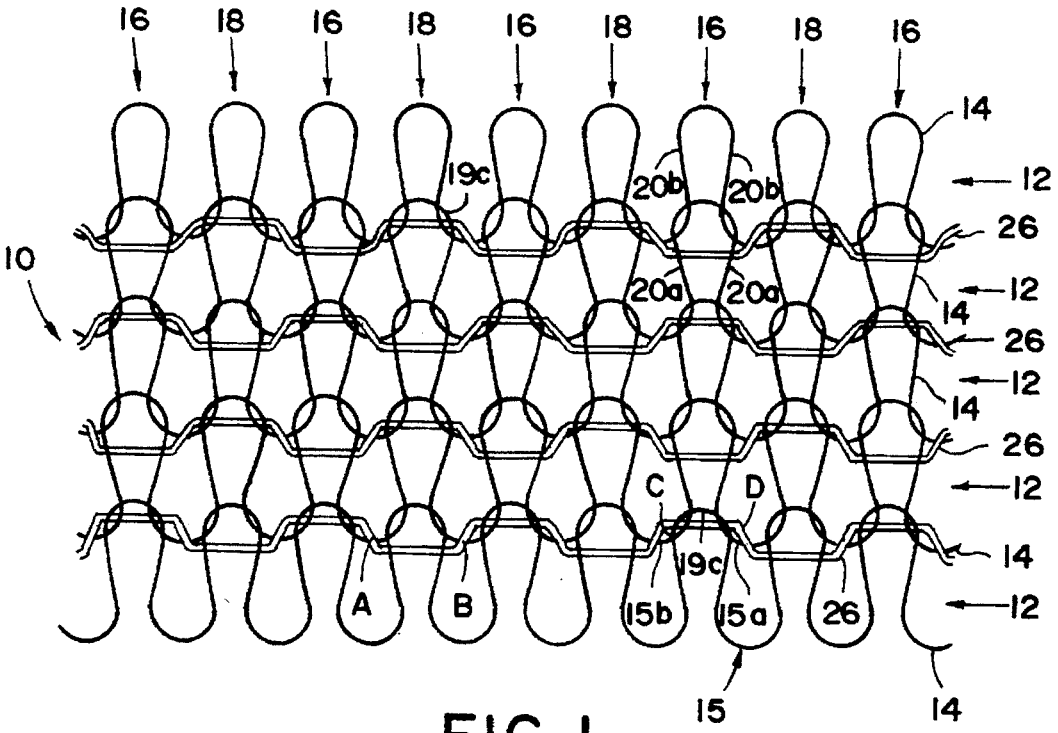
FIG. 1 is an illustration of a fabric according to a first embodiment of the present invention.

In FIG. 1, a portion of fabric 10 is illustrated which includes successive courses 12 of stitches formed from a ground yarn 14 and define a plain Jersey knit structure.

Laid-in on every course 12 is an elastomeric yarn 26. The elastomeric yarn 26 is laid-in so as to weave inbetween adjacent single wales 16, 18 and repeatedly cross-over the head of adjacent sinker loops 15.

In the embodiment shown in FIG. 1 the embodiment yarn 26 is laid-in so as to be located on the front side of each wale 16 or 18 on one course and the next elastomeric yarn 26 is laid-in so as to be located on the rear side of the same wale 16, 18 respectively on the next course.

Figure 2:
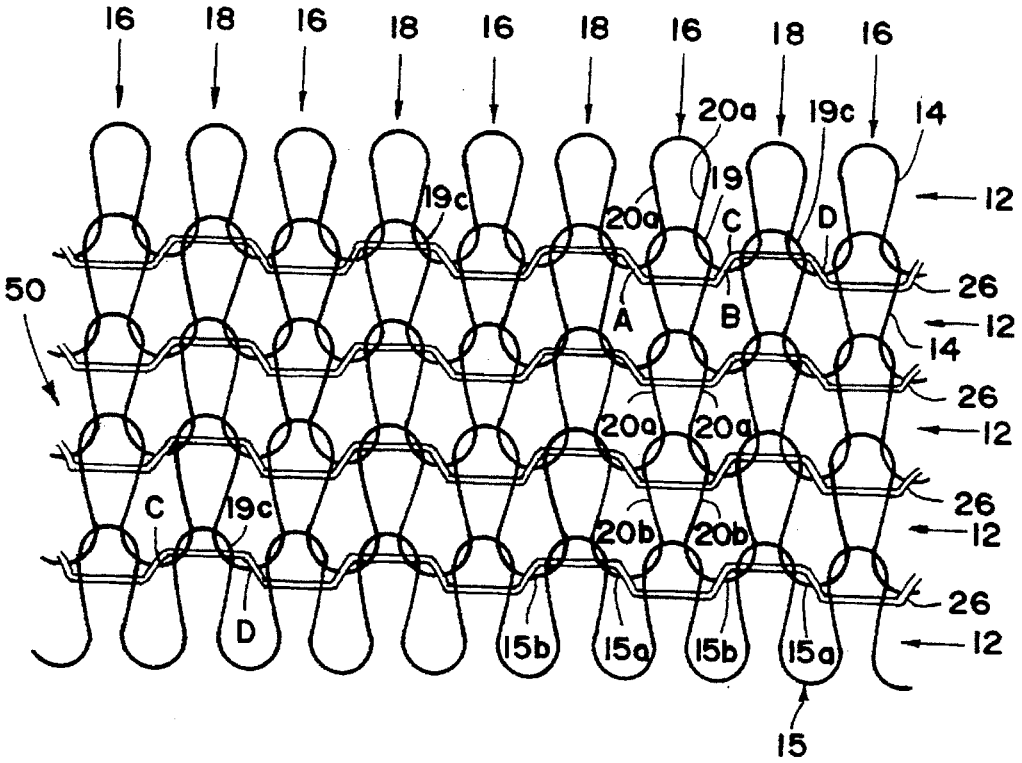
FIG. 2 is an illustration of a fabric according to a second embodiment of the present invention.

The fabric 50 shown in FIG. 2 differs from that in FIG. 1 in that the elastomeric yarns 26 are laid-in on successive courses so as to be located on the same side of a given wale 16 or 18 on every course.

Thus on a given course in either fabric 10 or 50 the elastomeric yarn crosses the head 15*a* of a sinker to extend toward the technical back of the fabric and then crosses the head 15*b* of the next sinker loop to extend toward the technical face of the fabric. In effect the cross-over points across the sinker loops 15 divide the elastomeric yarn 26 into two groups of length portions which alternate along the length of the elastomeric yarn 26.

Accordingly, the elastomeric yarn 26 has a first group of length portions extending between points A–B and a second group of length portions extending between points C–D.

The length portions A–B of the elastomeric yarn 26 extend between overlying and underlying limb portions 20*a*, 20*b* of connected needle loops formed in the same wale.

The elastomeric yarn 26 is laid-in under tension so as to be stretched during the laying-in process. The tension may be applied by a suitable tensioning device and/or the speed of rotation of the needle cylinder.

Preferably the degree of tension applied is such as to result in an elongation of the elastomeric yarn in the range of 3 to 5 times its relaxed length; more preferably 3 to 4 times or more preferably 3 to 3.5 times its relaxed length.

Accordingly, when the fabric leaves the needles, the elastomeric yarn 26 contracts.

Figure 3:
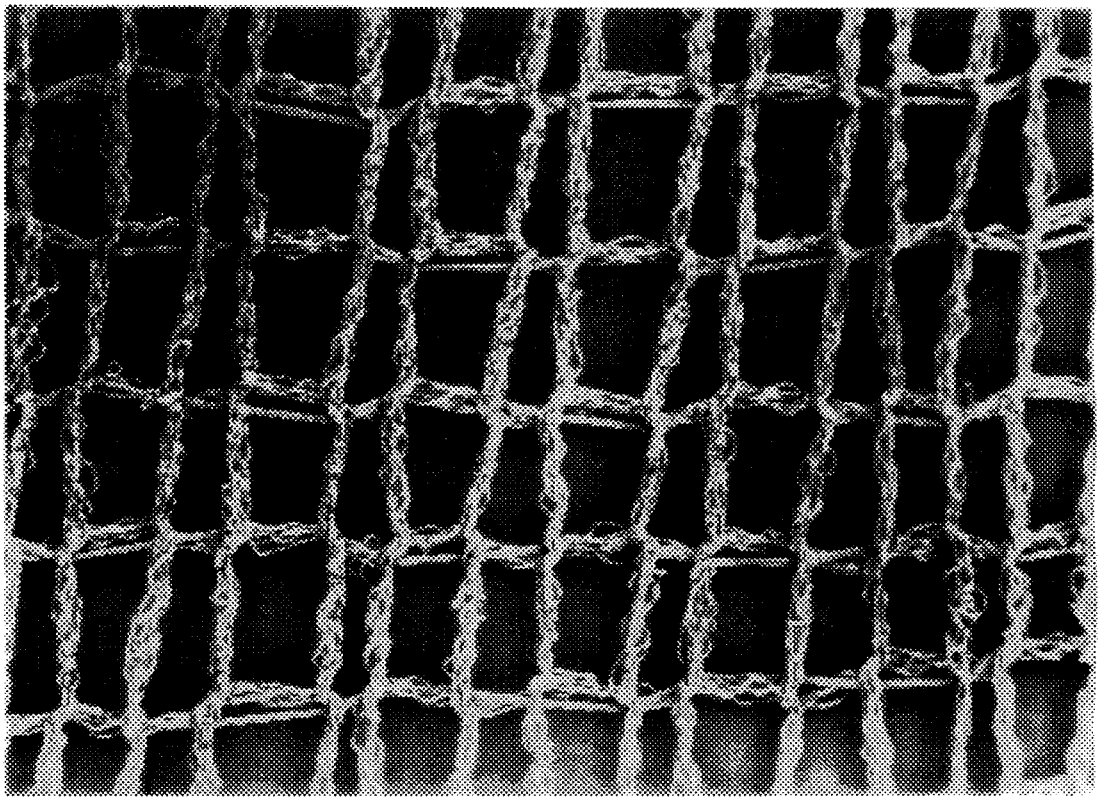
FIG. 3 is a magnified photograph of the fabric illustrated in FIG. 1 when in a stretched condition.
Figure 4:
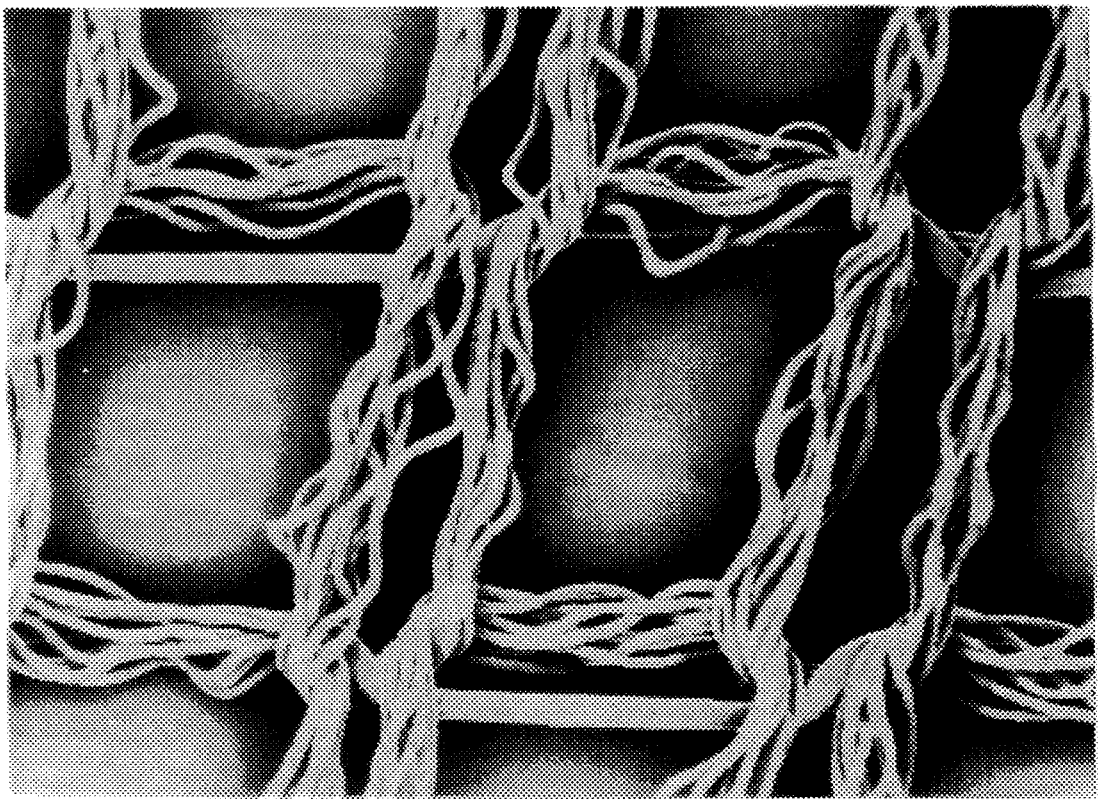
FIG. 4 is a photograph similar to FIG. 3 showing the fabric when relaxed and under higher magnification.

Thus, as seen in FIGS. 3 and 4, when leaving the knitting machine, the elastomeric yarn 26 tends to assume a straight line path and the adjacent sinker loop heads and needle loop heads also assume a generally straight line along the same path.

Accordingly the overlying limb portions 20*a* serve to prevent the elastomeric yarn portions A–B rising to the technical face of the fabric and the cross-over points with the sinker loops serve to prevent the elastomeric yarn rising to the technical back of the fabric. In addition, as seen in FIGS. 3 and 4, lengths A–B remain in tension and lie in parallel with the adjacent needle loop head. Thus, the length portions A–B are contained inbetween the front and rear face of the fabric and are thus shielded by the ground yarn from touch or surface abrasion.

The length of portions C–D extend across the back of limbs 20 adjacent to the needle loop head 19*c*. Thus, as knitted, the length portion C–D lies on the technical back of the fabric.

In order to shield or isolate the elastomeric yarn 26 so that it is not exposed to touch or abrasion on the fabric surface, the elastomeric yarn 26 and ground yarn 14 are chosen such that the length of each portion C–D as it extends along the needle loop head 19*c* is enclosed or embedded within the portion of yarn 14, which defines the needle loop head 19*c* yarn 14, to in effect shield that length portion of the elastomeric yarn.

It is possible to determine by examining the fabric whether or not the elastomeric yarn 24 has been successfully shielded by the loop heads 19*c* of the ground yarn 14. This is preferably done by visually inspecting the surface appearance of the fabric after it has been exposed to rubbing across a flat surface, as for example is the case when the panti-hose or stocking has been fed onto a board for heat setting. If the elastomeric yarn has not been successfully shielded the strands of elastomeric yarn will project from the surface of the fabric giving it a hairy appearance. This is caused by the elastomeric yarn frictionally engaging the surface and as a result being pulled out of the fabric. Conversely, the total absence or substantially total absence of strands of elastomeric yarn projecting from the surface will indicate that the elastomeric yarn has been successfully shielded by the ground yarn.

The choice of ground yarn 14 and elastomeric yarn 26 is such as to achieve the desired shielding of the elastomeric yarn 26 by the ground yarn 14.

Accordingly the ground yarn 14 may comprise any yarn which in combination with the elastomeric yarn will achieve this effect.

The fabric shown in FIGS. 3 and 4 has a ground yarn 14 which is 16 dtex 10 filament textured polyamide yarn and an elastomeric yarn which is an 11 dtex Lycra (RTM) yarn.

As clearly seen in FIGS. 3 and 4, the elastomeric yarn along length portions C–D is buried within the body of the yarn 14 and so is shielded from touch or abrasion by the ground yarn.

Accordingly, both the front and rear faces of the fabric are defined solely by the ground yarn 14 and the entire length of the elastomeric yarn 26 is located inbetween those front and rear faces by a degree which is sufficient to shield the elastomeric yarn from surface touch or abrasion.

As indicated above the ground and elastomeric yarns may be any type of yarn capable of producing, in combination, the embedding or enclosing of the length portions C–D.

Preferably the ground yarn is a non-elastomeric yarn, for example a polyamide or polyester yarn.

Preferably the ground yarn is a multi-filament yarn, such as a textured yarn, which on relaxation bulks to create spaces within the cross-section of the yarn for containing the elastomeric yarn to provide the shielding effect.

Accordingly, the yarn count of the ground yarn and the number of filaments are chosen to give a sufficient bulked cross-section to contain the elastomeric yarn. Similarly the elastomeric yarn is chosen to be of a yarn count and is laid-in under a predetermined degree of stretch such that the stretched elastomeric yarn is of a cross-sectional size which may be embedded or enclosed within the bulked ground yarn.

The ground yarn may be a plaited or covered yarn provided that it is capable of achieving the desired shielding effect with the elastomeric yarn. For example, the ground yarn could be covered elastomeric yarn in order to provide additional elasticity to the fabric. A suitable covered elastomeric yarn could be a covered yarn having a 15 dtex or 20 dtex elastane core covered by a 15 dtex 5 filament or 22 dtex 7 filament nonelastomeric yarn. In addition, suitable flat or stretch yarns may be used for the ground yarn 14.

The elastomeric yarn 26 may be any conventional elastomeric yarn such as an elastane, e.g. LYCRA (Registered Trade Mark)

The invention is primarily concerned with non-support type hosiery wherein the fabric exhibits a range of compressive pressures of between 2 to 6 mm of Hg measured on testing equipment in accordance with BS6612 (1985); more preferably between 2 to 5 mm of Hg and even more preferably between 2½ to 4½ mm of Hg.

Higher compressive pressures tend to be associated with support type garments. Such garments are not excluded from the present invention since the fabric of the present invention can be adapted to give a support fabric by incorporation of higher yarn counts of the elastomeric yarn.

Accordingly, it is envisaged that hosiery including fabric according to the present invention, may have a compressive pressure up to 12 mm of Hg in accordance with BS 6612 (1985)

Generally for non-support fabric the yarn count for the elastane is between 7 to 18 decitex and for the ground yarn is between 8 to 85 decitex.

Typical examples of combinations of yarns for a non-support type fabric according to the present invention are:

| Combination | Ground Yarn (polyamide) | Elastomeric Yarn (Lycra RTM-mono filament) |
|---|---|---|
| 1 | 8 decitex 5 filament | 8 decitex |
| 2 | 11 decitex 7 filament | 11 decitex |
| 3 | 17 decitex 5 filament | 11 decitex |
| 4 | 26 decitex 28 filament | 17 decitex |
| 5 | 16 decitex 10 filament | 11 decitex |

Generally for support fabric, the yarn count for the elastane is above 18 dtex and for the ground yarn is between 17 to 100 dtex.

Typical examples of combinations of yarns for a support type fabric according to the present invention are:

| Combination | Ground Yarn (polyamide) | Elastane Yarn (Lycra RTM-mono filament) |
|---|---|---|
| 1 | 26 decitex 28 filament | 22 decitex |
| 2 | 22 decitex 7 filament | 22 decitex |
| 3 | 22 decitex 7 filament | 44 decitex |
| 4 | 27 decitex 7 filament | 20 decitex |

The fabric 10 or 50 is preferably knitted on a circular knitting machine for the production of fine hose such as stockings or panti-hose. In such a case, the fabric 10 or 50 is knit so as to produce the entire leg portion of the stocking or panti-hose.

In the present invention, fine hose relates to any hose which is knit on a circular knitting machine having a gauge in the range of 300 needles per 4.5 inch diameter cylinder to 480 needles per 3.75 inch diameter cylinder. Preferably the range used is between 350 needles per 4.5 inch diameter Cylinder to 420 needles per 3.75 inch diameter cylinder.

More preferably for panti-hose or stockings, the gauge ranges between about 340–410 needles per 3.75 inch diameter cylinder to about 340–410 needles per 4 inch diameter cylinder.

For larger sized garments a circular knitting machine having a 470 needle ×4¼ inch diameter cylinder is suitable.

Figure 6:
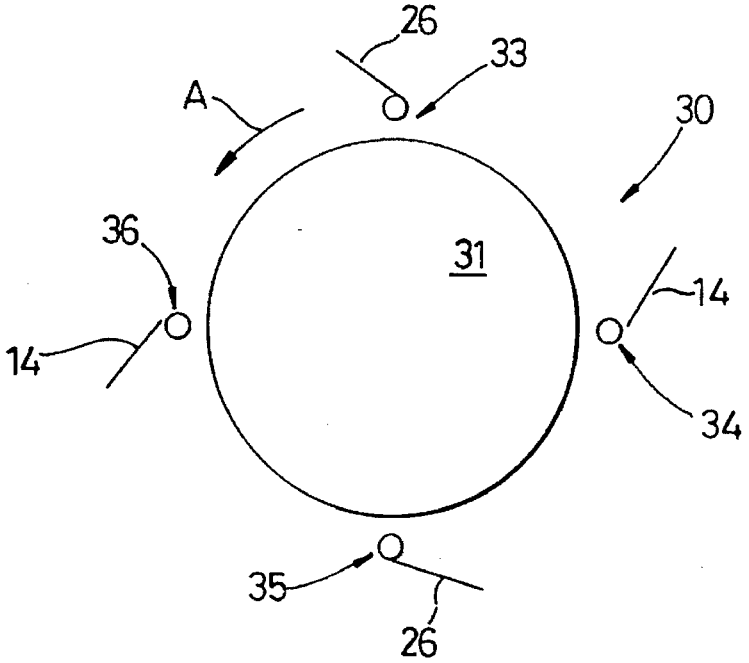
FIG. 6 is a diagrammatic plan view of a circular knitting machine.

In FIG. 6 a circular knitting machine is schematically illustrated at 30. The machine includes a needle cylinder 31 which rotates in the direction of arrow A and includes four yarn feed stations 33, 34, 35 and 36.

Alternate yarn feed stations are used for feeding in the foundation yarn 14 and the elastomeric yarn 26. This enables the elastomeric yarn 26 to be laid-in inbetween knitting of courses 12 at stations 34 and 36.

Figure 5:
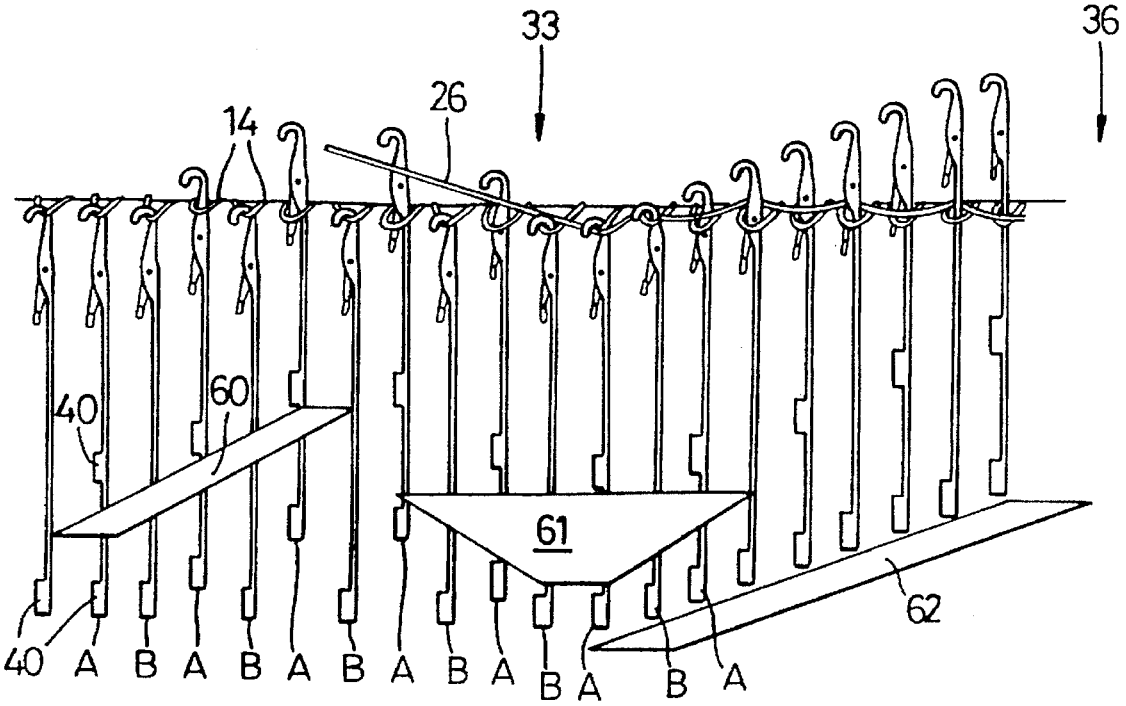

A feed station for yarn 26 is diagrammatically illustrated in FIG. 5. The needles of the knitting machine are arranged in two groups A, B, needles A having two butts 40; needles B having a single butt 40.

Needles travelling towards the feed station 33 are located at mis-knit height after completed knitting at the previous yarn feed station 34.

Needles A are raised to tuck height by a tuck raising cam 60 co-operating with the upper butts on needles A. Needles B not having an upper butt remain at mis-knit height.

Yarn 26 is laid-in the hooks of needles A and draw the yarn 26 down by the lower butts 40 on needles A engaging the stitch or lowering cam 61. On lowering the yarn 26 to the mis-knit height, the yearn 26 is trapped within the hooks of needles A but passes behind the intermediate needles B. Accordingly when the needles A, B are then subsequently raised to clearing height by the clearing cam 62 in preparation for receiving yarn 14 at ration 36, the elastomeric yarn 26 weaves inbetween adjacent needles A,B.

It is envisaged that the cam arrangement as described in our European Patent Specification 541380 may be used. Such a cam arrangement enables the needle cylinder to mn at speeds near to the maximum speed of the cylinder and thereby enables a greater degree of tension control on the elastomeric yarn.

For example, with a knitting machine having a maximum needle cylinder speed of 800 rpm it is possible, using the cam arrangement of EP 541380, to run the needle cylinder in excess of 700 rpm whilst laying-in.

In order to produce the fabric 10, alternate yarn feed stations 33, 35 for the yarn 26 operate to raise different needles to tuck height, e.g. at station 33 needles A are raised, at station 35 needles B are raised.

In order to produce the fabric 50, the same needles A are raised at each yarn feed station for yarn 26.

It is envisaged that the alternate wales 16 and 18 may be formed into alternate groups of wales wherein the elastomeric yarn passes across one face of more than one adjacent wale of one group before passing behind the wales of the next group. Such a fabric would be produced by arranging the needles A, B in groups e.g. three adjacent needles A separated by two needles B, etc. It is envisaged that the maximum number of needles A, B in any one group would be three.

It is envisaged that at alternate yarn feed stations for knitting courses 12, ground yarns 14 of opposite twist may be fed in. For example, at station 34 an S-twist yarn 14 may be fed in, whereas at station 36 a Z-twist yarn 14 may be fed in.

It will be appreciated that the circular knitting machine may only have one yarn feed station for yarn 14 and one yarn feed station for yarn 26. If two or more yarn feed stations are provided for ground yarns 14, then a yarn feed station for yarn 26 is provided inbetween each adjacent yarn feed station for yarn 14 in the direction of rotation of the needle cylinder.

It will be appreciated that garments made in accordance with the present invention may be other forms of hose such as trouser socks, knee highs or hold-ups.

It will be appreciated that laying-in the elastomeric yarn on every course is preferred in order to achieve a visually consistent fabric having the desired elastication performance. However in accordance with the present invention it is envisaged that a fabric superior to known fabrics may still be achieved by laying-in the elastomeric yarn on alternate courses.

We claim:

1. A hosiery garment including at least a leg portion comprising a fabric defined by a ground knitted structure having a plurality of successive courses knitted from a ground yarn and bare elastomeric yarn laid-in on every course of the ground knitted structure so as to cross-over the head of sinker loops between adjacent first and second groups of wales defined by needle loops of ground yarn, the laid-in elastomeric yarn having spaced length portions which extend across the technical back of each first group of wales, the ground yarn and elastomeric yarn being such that said length portions of the elastomeric yarn are embedded within the ground yarn of the needle loop heads in said first group of wales so that said lengths of elastomeric yarn reside below the technical back surface of the fabric.

2. A hosiery garment according to claim 1 wherein the ground yarn is a non-elastomeric, textured multi-filament yarn.

3. A hosiery garment according to claim 1 or 2 wherein the elastomeric yarn extends under tension through the knitted ground structure.

4. A hosiery garment according to claim 1 wherein the fabric is a non-support type fabric and the yarn count for the ground yarn is between 8 to 85 dtex and for the elastomeric yarn is between 7 to 18 dtex.

5. A hosiery garment according to any of claim 1 wherein the fabric is a support type fabric and the yarn count for the ground yarn is between 17 to 100 dtex and for the elastomeric yarn is above 18 dtex.

6. A hosiery garment according to claim 5 wherein the elastomeric yarn is an elastane yarn.

7. A hosiery garment according to claim 5 wherein the elastomeric yarn comprises one or more individual mono filaments.

8. A method of producing an elasticated knitted fabric including knitting a ground structure from a ground yarn so ms to have needle loops defining a plurality of consecutive courses and alternate first and second groups of wales, laying-in on every course an elastomeric yarn so as to cross-over sinker loops inbetween said first and second groups of wales, and selecting the ground and elastomeric yarns so that length portions of the elastomeric yarn extending across the technical back of the first group of wales are enclosed within the portions of ground yarn defining the needle loop heads in said first group of wales so as to be shielded thereby.

9. A method according to claim 8 wherein the elastomeric yarn is laid-in under a tension so as to be elongated by 2 to 5 times its relaxed length.

* * * * *